United States Patent [19]

Schiminski et al.

[11] 4,431,138

[45] Feb. 14, 1984

[54] METHOD AND APPARATUS FOR WINDING YARN

[75] Inventors: Herbert Schiminski, Huckeswagen; Herbert Turk, Remscheid, both of Fed. Rep. of Germany

[73] Assignee: Barmag Barmer Maschinenfabrik AG, Remscheid, Fed. Rep. of Germany

[21] Appl. No.: 363,847

[22] Filed: Mar. 31, 1982

[30] Foreign Application Priority Data

Apr. 4, 1981 [DE] Fed. Rep. of Germany ..... 3113751
Jun. 6, 1981 [DE] Fed. Rep. of Germany ..... 3122705
Aug. 5, 1981 [DE] Fed. Rep. of Germany ..... 3130975

[51] Int. Cl.[3] ..... B65H 54/06; B65H 67/04

[52] U.S. Cl. ..... 242/18 A; 242/18 PW; 242/43 R; 242/157 R

[58] Field of Search ..... 242/18 A, 18 PW, 18 DD, 242/18 R, 25 A, 43 R

[56] References Cited

U.S. PATENT DOCUMENTS 3,797,767 3/1974 Schippers et al. ..... 242/43 R
3,825,206 7/1974 Schippers et al. ..... 242/18 DD
3,856,222 12/1974 Wust ..... 242/18 A
3,861,607 1/1975 Schippers et al. ..... 242/43 R
4,084,760 4/1978 Nakano et al. ..... 242/18 A
4,216,920 8/1980 Tambara et al. ..... 242/18 A
4,298,171 11/1981 Flückiger et al. ..... 242/18 A

*Primary Examiner*—Stanley N. Gilreath
*Attorney, Agent, or Firm*—Bell, Seltzer, Park & Gibson

[57] ABSTRACT

A method and apparatus is disclosed for serially winding a high speed running yarn onto bobbins without yarn stoppage between bobbin changes, and without loss of yarn. The method and apparatus includes at least two bobbin receiving chucks which are adapted to be serially delivered to a winding position. When the first bobbin becomes full, it moves laterally away from the yarn traverse guide, and the chuck with an empty bobbin and an associated yarn catching notch is moved into the yarn path of travel while being rotated, and with the notch being positioned axially outside the yarn traverse stroke along the empty bobbin. The separated full bobbin, which continues to receive the yarn, is then moved axially so that an end portion is aligned with the plane of the yarn catching notch on the empty bobbin. An auxiliary yarn guide is then moved to engage the yarn and terminate its traverse. The auxiliary guide then moves the yarn into the plane of the yarn catching notch, and so that the yarn is wound on the axially extended end portion of the full bobbin, until the notch catches the yarn, at which point the yarn commences to be wound upon the rotating empty bobbin. The auxiliary yarn guide then releases the yarn so that it is caught and again traversed by the traverse guide.

24 Claims, 25 Drawing Figures

METHOD AND APPARATUS FOR WINDING YARN

The present invention relates to a method and apparatus for winding a high speed running yarn onto bobbins serially presented to a winding position, and without yarn stoppage or loss of yarn between bobbin changes.

In the winding of continuously running filament yarns, loss free doffing of the packages, i.e. a loss free replacement of a full bobbin with an empty bobbin, has been proposed. Typically, in such prior proposals, at least two winding chucks are provided which are alternately moved to a winding position, wherein the yarn is wound on a bobbin mounted on the chuck. A traverse motion device precedes the winding station in the direction of the threadline, so as to form a cross-wound package. The winding apparatus includes a revolving chuck mounting device, which rotates about a horizontal axis. This mounting device, for example, accommodates two chucks projectingly and rotatingly supported so as to rotate parallel to its axis of rotation. Each winding chuck can accommodate a number of empty bobbins corresponding to the number of yarns to be wound. Since the continuously running yarns are usually synthetic fibers, which are spun in a vertical direction from top to bottom, the traverse motion device is located above the chuck mounting device, or in any event precedes the mounting device in the direction of the threadline. This traverse motion device displaces the yarn essentially perpendicularly to its running direction across an operative portion of the bobbin length by a reciprocating motion, so that the yarn forms a cross-wound package. For the purpose of doffing a full bobbin, a yarn catching notch is provided on each chuck or on each tube, in a number corresponding to the number of yarns, which notches are capable of holding a running yarn on the rotating winding chuck or bobbin, respectively. Furthermore, the winding apparatus has an auxiliary yarn guide in the area of the traverse motion device, which is suitable for moving the yarn essentially perpendicularly to its running direction and outside of the displacement stroke.

An object of the present invention is to provide a winding method and apparatus which allows a loss free doffing of the full bobbins in the above-described manner, and such that there is no waste and no impairment of quality while the bobbins are doffed. It is also an object to provide for such doffing of full bobbins on a winding apparatus which is adapted to concurrently wind a plurality of filament yarns, in particular, more than four, on a corresponding number of empty bobbins. In this regard, the textile industry typically produces and processes a large number of yarns on one machine, and it is desirable to design both the individual assemblies of the textile machine and the winding apparatus, as compactly as possible. For this reason, devices should be avoided which widen the individual assemblies, i.e. increase the width of the textile machine. Therefore, another and particular object of the present invention is to provide a doffing arrangement which does not require outwardly projecting equipment.

The above objects and advantages of the present invention are achieved in the embodiments illustrated herein by the provision of a method and apparatus which includes means rotatably mounting at least two bobbin receiving chucks for selective movement wherein each chuck may be serially delivered to and withdrawn from a winding position. Each chuck is adapted to coaxially mount at least one bobbin, upon which the yarn is adapted to be wound. A yarn traverse guide is mounted at a location upstream of the winding position for traversing the running yarn to form a cross wound package on a bobbin received on a chuck at the winding position. Upon such bobbin becoming full, the chuck is laterally separated from the traversing yarn guide, and such that the length of the running yarn between the yarn guide and the full bobbin increases and the traverse stroke of the yarn on the full bobbin decreases. A second chuck mounting at least one empty bobbin and an associated yarn catching notch adjacent one end of the bobbin, is then moved to a yarn engaging position between the traversing yarn guide and the full bobbin and such that the yarn catching notch is positioned axially beyond the yarn traverse stroke which is defined along the empty bobbin.

Preferably, the second chuck and empty bobbin are rotated during this movement to the yarn engaging position. Upon the rotating full bobbin reaching the separated position, it is axially displaced so that an end portion thereof is laterally aligned with the plane of the yarn catching notch on the empty bobbin at the yarn engaging position. Thereafter, an auxiliary yarn guide is moved into the path of the traversing yarn so as to engage the yarn and terminate its traverse. The auxiliary yarn guide and retained running yarn is then moved into the plane of the yarn catching notch, such that the yarn is wound on the end portion of the full package until it is caught by the notch, whereby the yarn is broken and is thereafter wound upon the empty bobbin.

The prior U.S. patent to Wust, No. 3,856,222 discloses a winding apparatus wherein the winding chuck supporting the empty bobbin is axially displaced to start its rotation and permit the yarn to engage a yarn catching notch. However, the axial movement required for this purpose must be performed very quickly, in order to insure that the transfer tail is sufficiently short to permit the tail to be pulled from the package for tieing to the yarn of another package. Thus, the axial movement involves very substantial acceleration and deceleration forces. As a result, very costly technical equipment is required, and its operation may lead to damaging vibrations or shocks to the winding apparatus and the textile machine.

The present invention avoids these disadvantages. Here, the axial displacement of the chuck supporting the empty bobbin is not required to start the winding operation on the empty bobbin, i.e. to catch the yarn and form a transfer tail. Rather, the axial displacement of the chuck with the full bobbin assures that the running yarn does not fall from the full bobbin, when the yarn is guided outside the range of the traverse stroke.

Some of the objects of the invention having been stated, other objects and advantages will appear as the description proceeds, when taken in connection with the accompanying schematic drawing, in which FIG. 1 is a schematic front elevation view of a winding apparatus embodying the features of the present invention;

Figure 1:
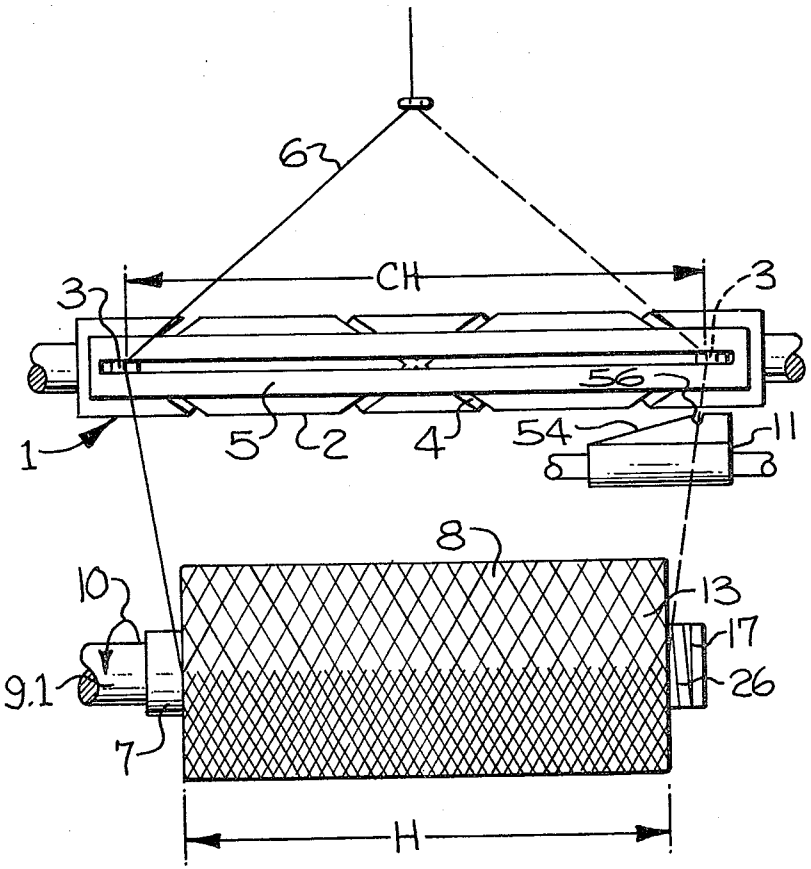
FIG. 1A is a side elevation view of the apparatus shown in FIG. 1.
Figure 1A:
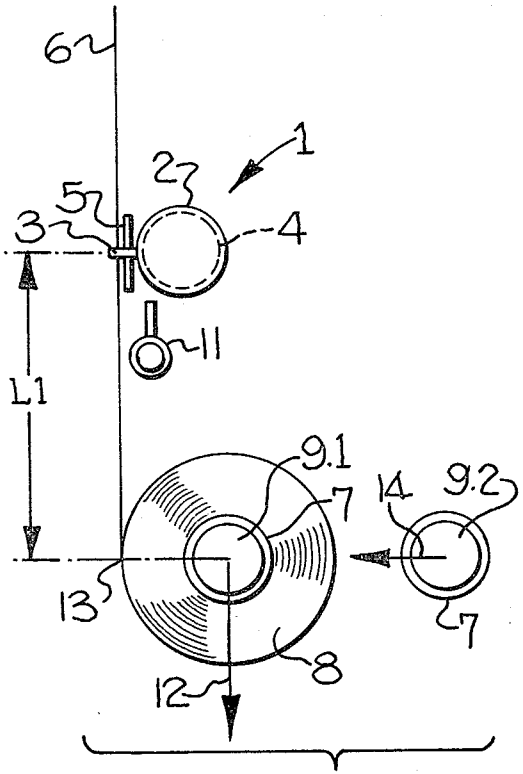

Referring more specifically to the drawings, FIGS. 1 and 1A illustrate an embodiment of a yarn winding apparatus in accordance with the present invention. The apparatus includes a yarn traverse device 1, which includes a cross-spiralled roller 2 and traversing yarn guide 3. Traversing yarn guide 3 reciprocates in grooves 4 of the cross-spiralled roller, and is guided along a linear path of travel by the slotted guide 5. By the movement of traversing yarn guide 3, the filament yarn 6 is wound on bobbin 7, to form cross-wound package 8. Bobbin 7 is firmly placed on winding chuck 9.1, which is driven in a manner (not shown) in the direction of rotation 10. During the winding process, a second winding chuck 9.2 with an empty bobbin 7 supported thereon, is on stand-by. Auxiliary yarn guide 11 is also on stand-by, and will be described further below.

Figure 2:
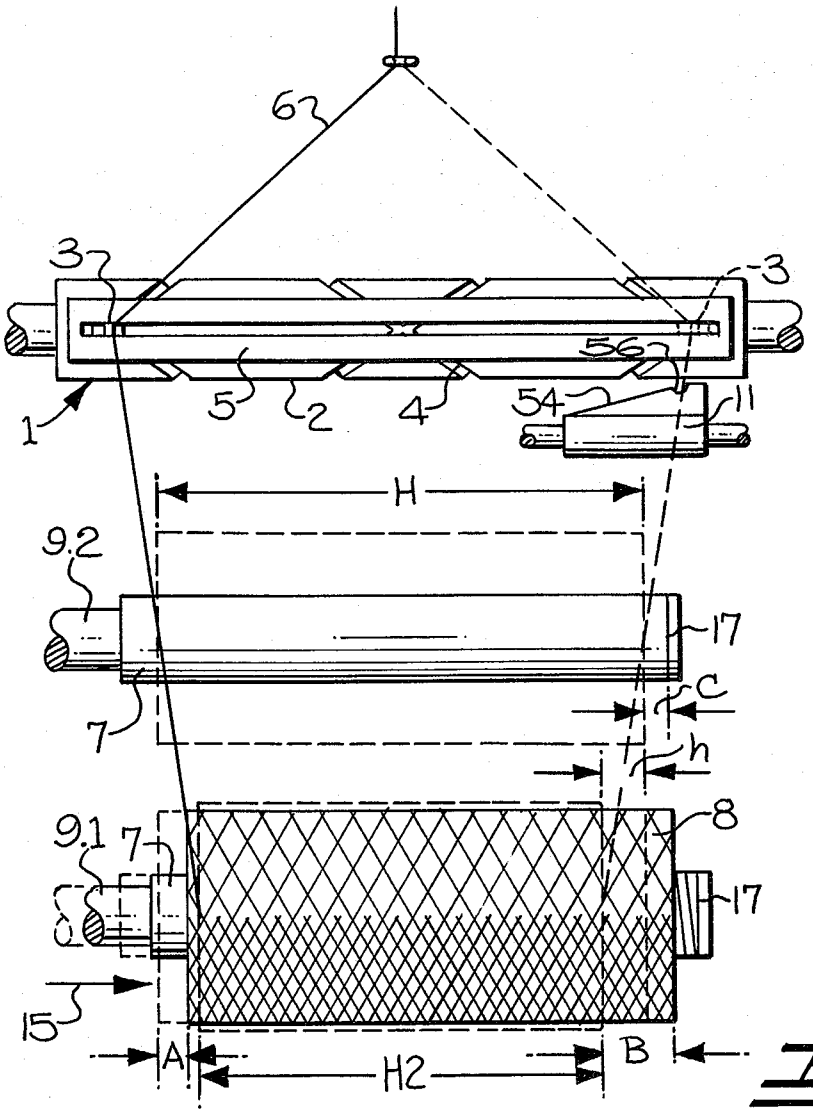
FIG. 2 is a view similar to FIG. 1, but illustrating the apparatus with the full bobbin withdrawn from the traversing yarn guide.
Figure 2A:
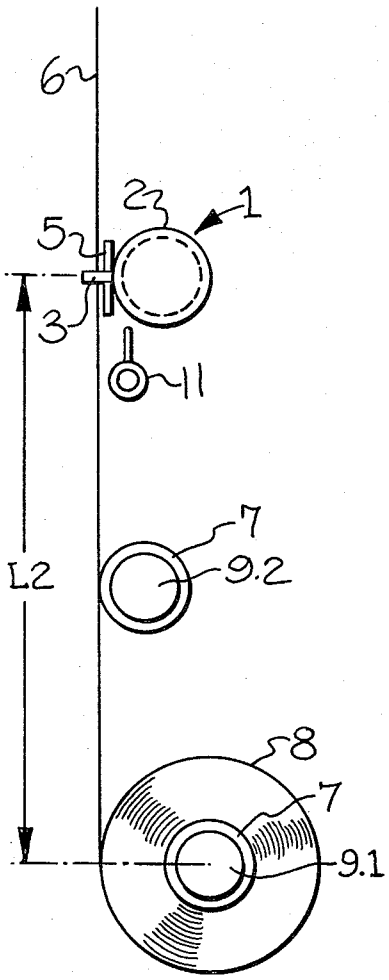
FIG. 2A is a side elevation view of the apparatus shown in FIG. 2.

After or shortly before the completion of the winding process, i.e., when package 8 is essentially full, winding chuck 9.1 is moved away from the traverse device 1 in direction 12, so that trailing yarn length L1 between traversing yarn guide 3 and line 13, where the yarn contacts the package, increases to trailing length L2. Concurrently with this movement, winding chuck 9.2 and empty bobbin 7 move in direction of arrow 14 into the plane of threadline 6, and until they reach the yarn engaging position as shown in FIGS. 2 and 2A.

By increasing trailing yarn length L1 to L2, the traverse stroke H determined by the traverse stroke CH of yarn guide 3, i.e. the package length, is reduced to displacement stroke H2. This reduced displacement stroke H2 makes it possible to shift winding chuck 9.1 in direction 15 by the amount A, without the yarn, which is still in the traverse motion device, falling from the surface of the package. As will be understood, A should be less than h, which represents one half of the difference between H and H2. It should here be noted that winding chuck 9.2 with the empty bobbin 7 remains in its original position when the yarn is shifted, i.e. it is not axially displaced.

Upon the axial displacement of winding spindle 9.1, a distance B develops between the right front face of the full cross-wound package 8, and the right front face of the new displacement stroke H2, with B being greater than h, but smaller than twice h.

Figure 3:
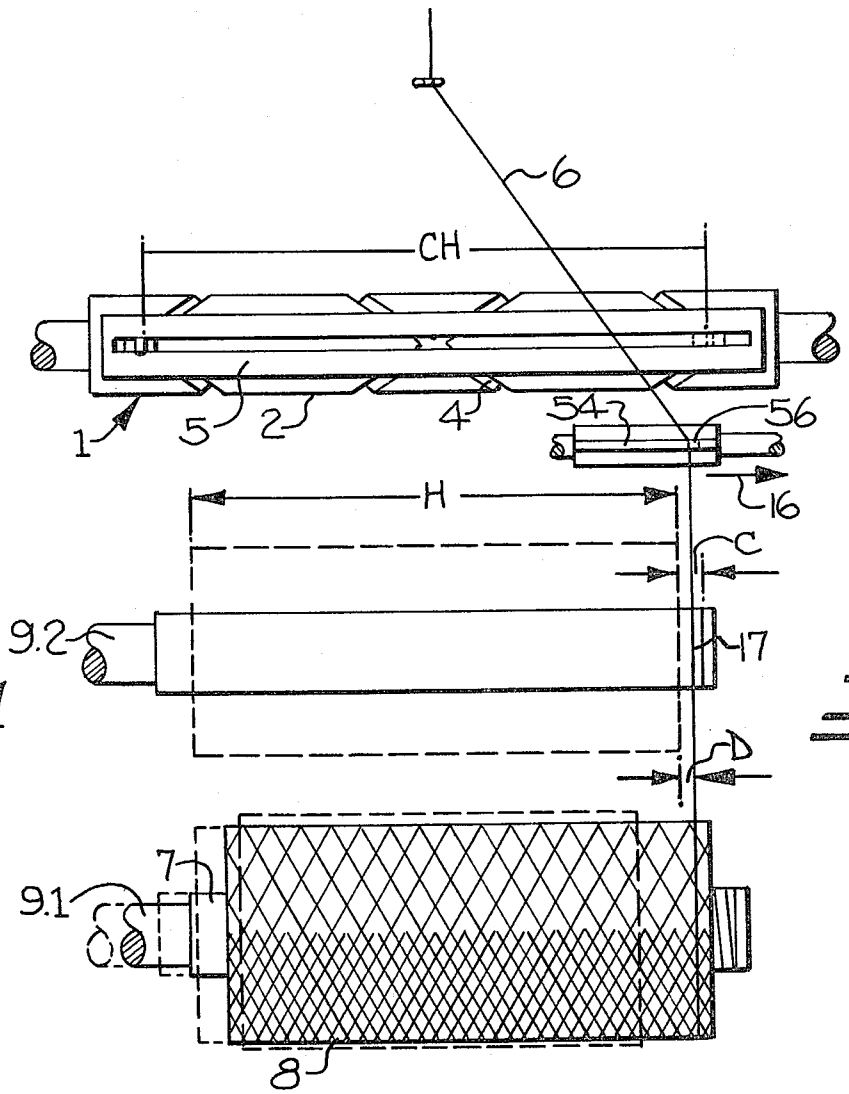
FIG. 3 is a view similar to FIG. 2, but showing the apparatus with the auxiliary yarn guide in an operative position.
Figure 3A:
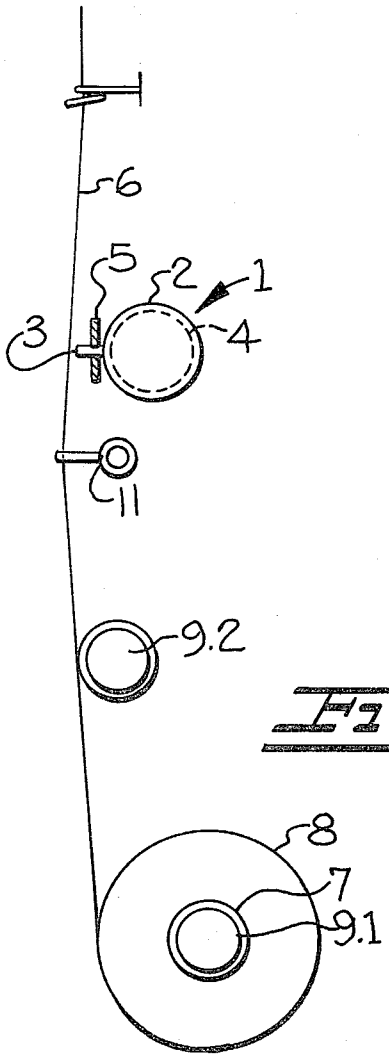
FIG. 3A is a side elevation view of the apparatus shown in FIG. 3.

At this point in time, the auxiliary yarn guide 11 pivots or swings into the plane of threadline 6, note FIG. 3. The yarn runs on the inclined edge surface 54 of auxiliary yarn guide 11, and is thereby lifted out of traversing yarn guide 3 and is caught in a yarn guide slot 56. By the lateral movement 16 of the auxiliary yarn guide, the yarn is moved outside the range of the traverse stroke CH, namely, slightly beyond the yarn catching slot 17 provided in each bobbin 7, but not beyond the normal plane of the right front face of the full package 8 in its axially displaced position. The length of movement C, which auxiliary yarn guide 11 performs beyond the right end of the normal displacement stroke H, is consequently greater than or at least the same as distance D, which yarn catching notch 17 measures from the right edge of the normal displacement stroke H. However, the length of movement C is smaller than the amount A, by which winding spindle 9.1 is axially displaced. This ensures that, as is shown in FIG. 3, the yarn can be brought into the normal plane of the yarn catching notch, without falling from the circumference of full package 8, and thus even during the yarn catching process, the running yarn continues to wind on the full package and is conveyed by the full package.

FIGS. 4 through 8 illustrate the sequence of the method steps according to the invention, as they occur when packages are doffed on a winding apparatus as is essentially shown, for example, in the U.S. Pat. No. 3,825,206. A bobbin mounting device in the form of a bobbin revolver 18, which rotates about axis 19, rotatably supports the winding chucks 9.1 and 9.2. Further, each winding chuck is equipped with an engageable and disengageable auxiliary drive, which is indicated schematically in FIG. 4. Drive roll 20 drives the packages formed on winding chucks 9.1 or 9.2, respectively. The traverse motion assembly includes a cross spiralled roller 2, and a traversing yarn guide 3, (as described in conjunction with FIGS. 1–3), and further there is provided a grooved roller 21 which is looped by the filament yarn 6, and the drive roll 20. The roller 21 preferably includes reversing grooves at each end thereof, of the type specifically disclosed in U.S. Pat. Nos. 3,797,767 and 3,861,607. Also, the traverse motion assembly is mounted on a vertically movable support carrier 22, as is indicated by the arrows in FIG. 4. Details of the illustrated traverse motion assembly are further disclosed in U.S. patents referenced immediately above, the disclosures of which are incorporated by reference.

Figure 4:
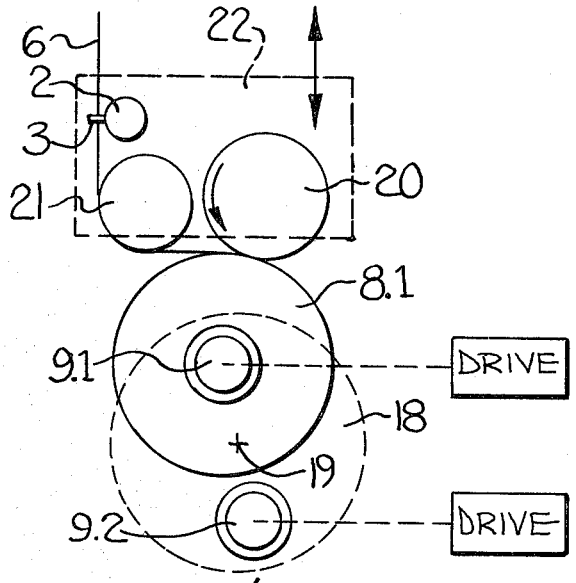
FIGS. 4–8 are schematic side elevation views of a second embodiment of a winding apparatus which incorporates the features of the present invention, with the figures serially illustrating the operative steps of the method.
Figure 5:
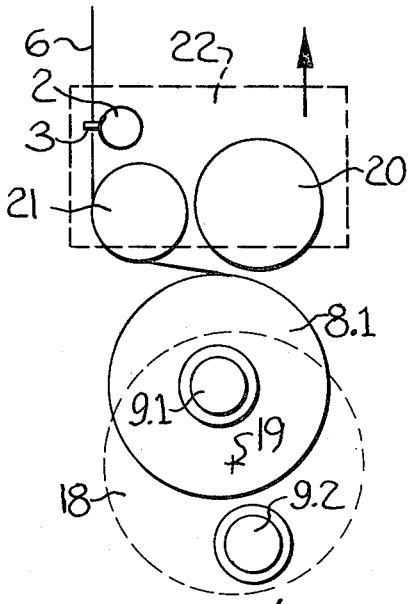
Figure 6:
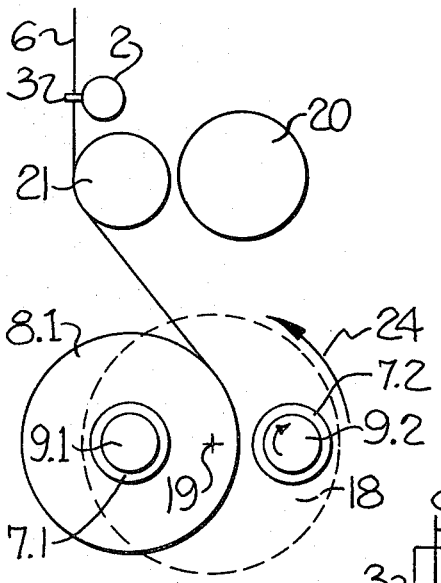
Figure 7:
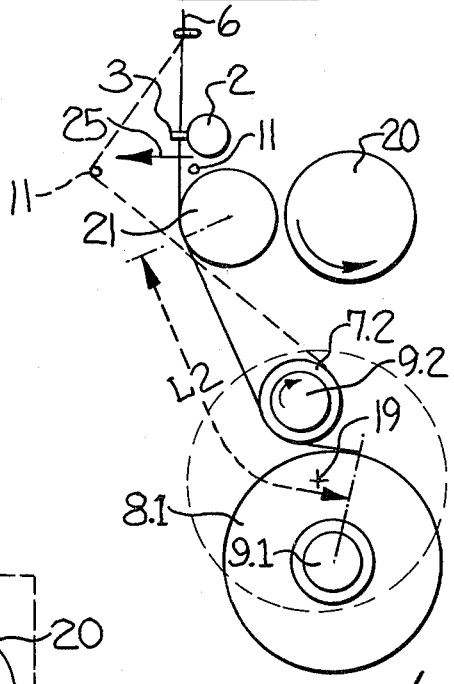

FIG. 4 illustrates the winding position for the full package 8.1. In this position, the yarn 6 passes through the traversing yarn guide 3, and is looped by at least 60 degrees over the grooved roller 21. For the purpose of doffing a package, the slide 22 moves first upwardly so that drive roll 20 disengages from the full package 8.1, note FIG. 5. Next the revolver 18 rotates in direction 24 (FIG. 6) until winding chuck 9.2 with empty bobbin 7.2 supported thereon, reaches the threadline. While doing so, trailing length L2 between the point where the yarn leaves the grooved roller 21, and the point where it contacts the full package 8.1, considerably increases, and the displacement stroke decreases correspondingly. The looping angle of the yarn about the roller 21 also decreases to less than about 45 degrees. This reduction of the looping angle on grooved roller 21 when full package 8 moves away, also causes the yarn in the reversal areas to drop from the reversing grooves, which results in a further reduction of the traverse stroke. Now, as described in conjunction with FIGS. 2 and 3, winding chuck 9.1 axially shifts in direction 15 (FIG. 2) in such a manner that, for example, the left front face of the full package 8.1 approximately coincides with the left end of the shortened displacement stroke. Auxiliary yarn guide 11 then lifts the yarn out of traversing yarn guide 3 and grooves 21 in direction 25 (FIG. 7), and guides it into, or somewhat beyond, the plane of the yarn catching notch 17 on winding spindle 9.2.

Figure 8:
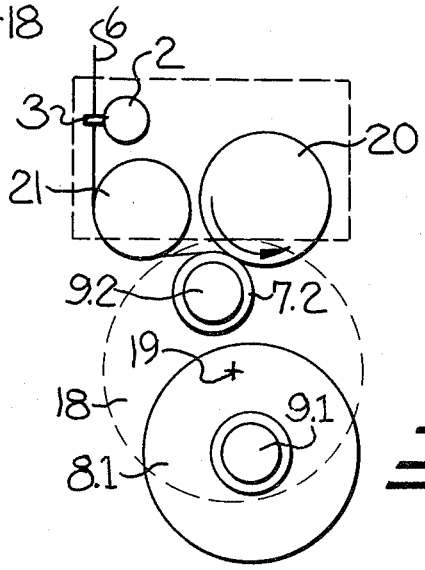

The yarn catching notch 17 for textile filament yarns is preferably arranged on the circumference of bobbin 7 and is located somewhat outside of the traverse stroke H. Auxiliary yarn guide 11 performs a very slow axial movement in the area of the normal plane of the bobbin in which the notch or slot 17 is positioned, so that the yarn may be safely caught. Then, auxiliary yarn guide 11 returns to the area of the normal traverse stroke at a high speed, so that, only a few windings of a transfer tail are produced between yarn catching notch 17 and the adjacent side of the normal winding range H. As soon as auxiliary yarn guide 11 has again reached the traverse area CH, it is returned to its non-operative position so that the yarn is released and again caught by the traverse motion device and wound into a cross-wound package. In doing so, winding chuck 9.2 or the empty bobbin placed thereon, is again brought in contact with drive roll 20 by returning support carrier 22 to its basic position, and by correspondingly further rotating the revolver 18. The operating position of winding chuck 9.2 is shown in FIG. 8.

It should be noted that the doffing operation can be performed so quickly that full package 8.1 does not usually require any further drive due to its inherent forces of inertia (see U.S. Pat. No. 3,825,206). Of course, the auxiliary drive for the chuck 9.2 may be operated to maintain a desired rotational speed if required. In this regard, winding chucks 9.1 and 9.2 may be driven before and during the transfer of the yarn by their auxiliary drives in such a manner that their surface speed essentially corresponds to or is somewhat above the yarn speed.

Figure 9:
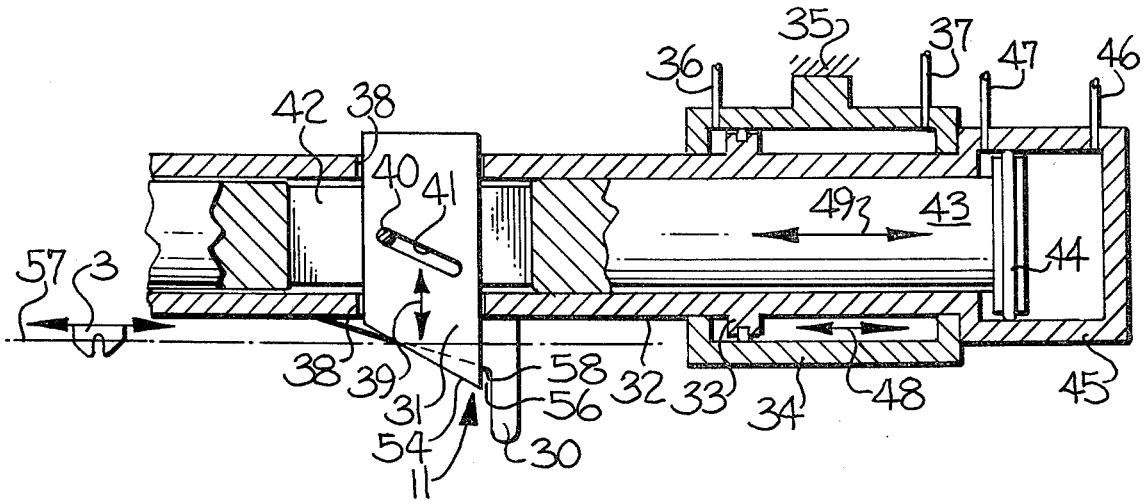
FIG. 9 is a fragmentary sectioned top plan view of an auxiliary yarn guide in accordance with the present invention.

In a winding apparatus according to FIGS. 4–8, the auxiliary yarn guide 11 may be designed and constructed as shown in FIGS. 1–3. However, FIGS. 9–11 illustrate another preferred embodiment which provides a particularly reliable operation. In particular, the guide 11 includes a support tube 32 which is mounted to the frame 35 of the winding machine by means of a housing 34, and so as to permit the tube to selectively move in each direction 48 along a linear path of travel which is parallel to the yarn traverse stroke 57, and parallel to the axial direction of the winding chuck. A guide finger 30 is fixed to the support tube 32 and extends transversely therefrom in a direction so as to intersect the plane of the traverse stroke 57.

In order to move the tube 32 in the direction 48, there is provided a collar or piston 33 within the housing 34, and upon which compressed air is applied through lines 36 or 37. A rod 43 is slideably mounted in the tube 32 for movement in direction 49, and the rod 43 includes a piston 44 in the form of an end flange, which is housed in a cylinder 45 formed to the end of the tube 32. Compressed air is applied in cylinder 45 through lines 46 or 47. This construction enables rod 43 to move relative to the tube 32 when compressed air is applied in cylinder 45.

A guide plate 31 is mounted to the support tube 32 for movement in a direction 39 perpendicular to the path of travel of the tube, and between an extended position as seen in FIG. 9, and a withdrawn position. The guide plate 31 is positioned immediately adjacent the guide finger 30 so as to define a yarn receiving slot 56 therebetween when the plate 31 is extended. The plate includes a forward edge 54 which is inclined outwardly in a direction toward the finger.

The guide plate 31 is supported for its transverse movement within radial slots 38 in the tube 32, and it is connected to the rod 43 by a pin 40 and slot 41. Thus when rod 43 moves in direction 49 relative to tube 32, the plate 31 moves along the direction 39.

FIGS. 10A through 10F illustrate the operation of the auxiliary yarn guide 11 shown in FIG. 9 in its various phases. In these Figures, line 50 represents the end of the traverse stroke CH of the guide 3, and notch 51 the yarn catching notch on tube 52. The transfer tail is indicated at 53.

Figure 10A:
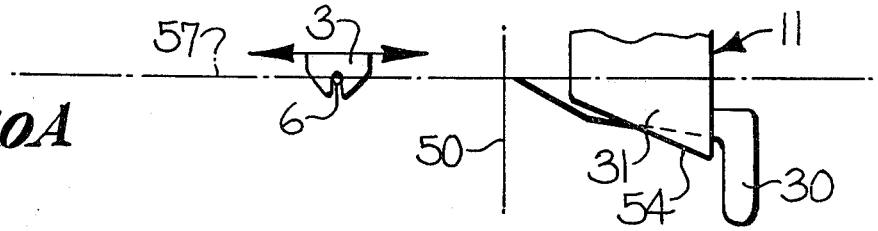
FIGS. 10A through 10F are fragmentary plan views illustrating the sequence of the operative steps of the auxiliary yarn guide illustrated in FIG. 9.

In the phase of FIG. 10A, auxiliary yarn guide 11 is in its idle position outside the end 50 of the traverse stroke CH. Yarn 6 reciprocates in traversing yarn guide 3, or, in the embodiment of FIGS. 4–8, the yarn would additionally pass along the grooves of a grooved roller.

Figure 10B:
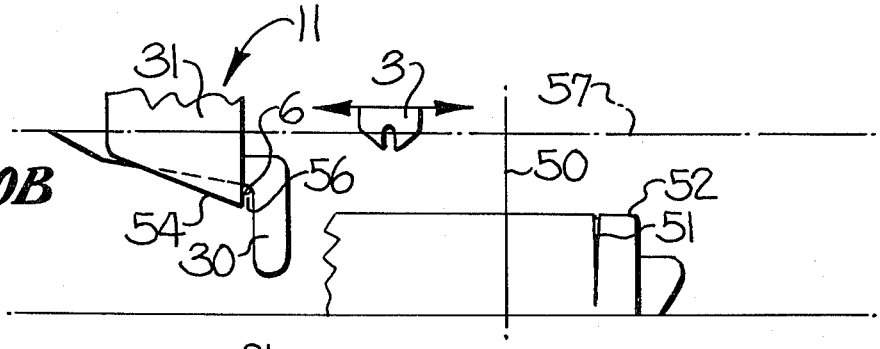

In the phase of FIG. 10B, the yarn guide 11 moves into the traverse range stroke CH, with the yarn sliding upwardly on inclined surface 54 so as to be lifted out of traversing yarn guide 3. The yarn then drops into yarn guide slot 56, which is formed between finger 30 and plate 31. It should be noted that yarn guide 11 is so guided that finger 30, inclined surface 54, and also the bottom of the yarn guide slot 56 lie on the side of the threadline plane 57, which is opposite that of the traverse motion device.

Figure 10C:
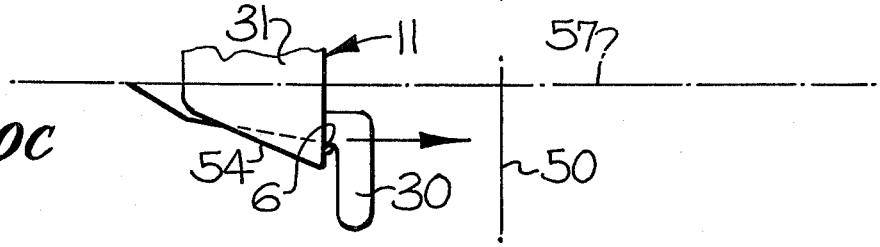
Figure 10D:
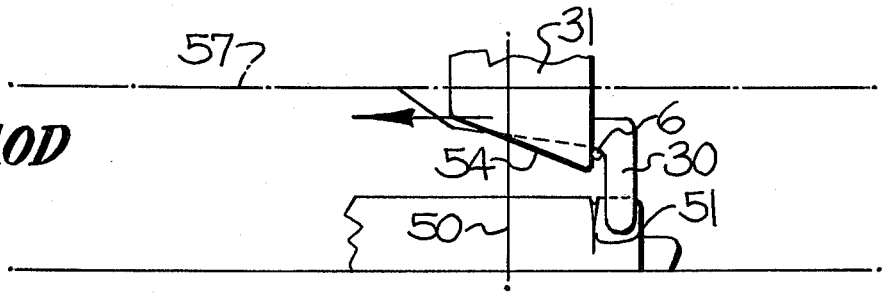
Figure 10E:
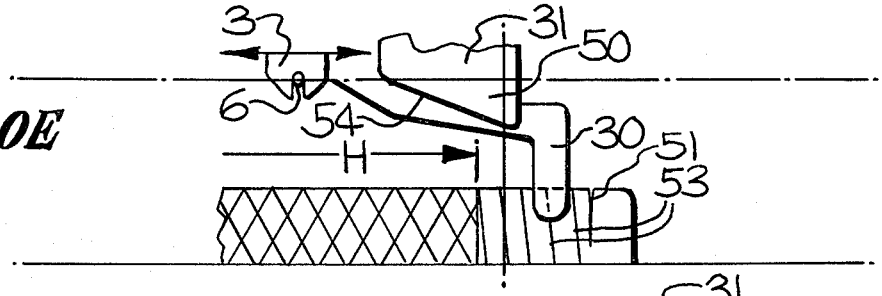

In the phase of FIG. 10C, the auxiliary yarn guide performs a slow movement to the right into the area of the plane which extends perpendicularly through the yarn catching notch 51 and, after the yarn has been caught (FIG. 10D), it moves quickly to the left until it reaches the position shown in FIG. 10E. To effect these various movements, compressed air is applied to piston 33 through the line 37, then line 36, while piston 44 remains acted upon via line 46.

In the phase of FIG. 10E, plate 31 is retracted behind the bottom of yarn guide slot 56 so that the yarn, due to its own tension moves back into the traverse stroke CH, where it is recaptured by self-catching yarn guide 3, or the grooves of the grooved roller. The reciprocal motion of the guide 3 acts to wind the yarn into a package with length H. In doing so, a tail 53 is formed which is composed of a few windings. To effect movement of the plate 31, the piston 44 is acted upon via line 47, while piston 33 remains acted upon via line 37.

Figure 10F:
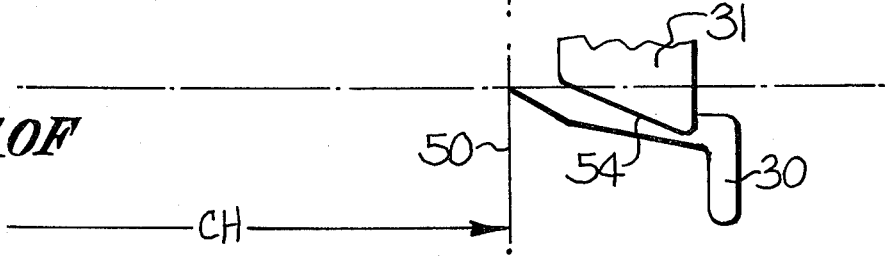

In the phase of FIG. 10F, the auxiliary yarn guide moves back to its initial position, with plate 31 remaining retracted for the time being. For this purpose, piston 33 receives a compressive force via line 36, while piston 44 remains under pressure via line 47. Thereafter, plate 31 moves out again, which is done by applying pressure to piston 44 via line 46.

FIGS. 11A through 11F illustrate the operation of the auxiliary yarn guide 11 and wherein the yarn catching notch is located on the tube within the traverse stroke CH or the winding range H. It should be noted that such a winding apparatus does not require an axial displacement of the winding chuck.

Figure 11A:
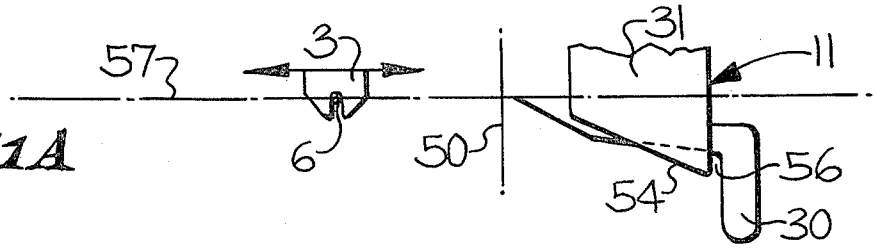
FIGS. 11A through 11F are views similar to FIGS. 10A through 10F, and illustrating the manner in which the auxiliary yarn guide functions with a bobbin receiving chuck of different design.

In the phase of FIG. 11A, auxiliary yarn guide 11 is in its idle position, while yarn 6 reciprocates in traversing yarn guide 3 or, as is in the case with a winding apparatus according to FIGS. 4–8, also in the grooves of a grooved roller. In doing so, the yarn defines an essentially vertical threadline plane 57.

Figure 11B:
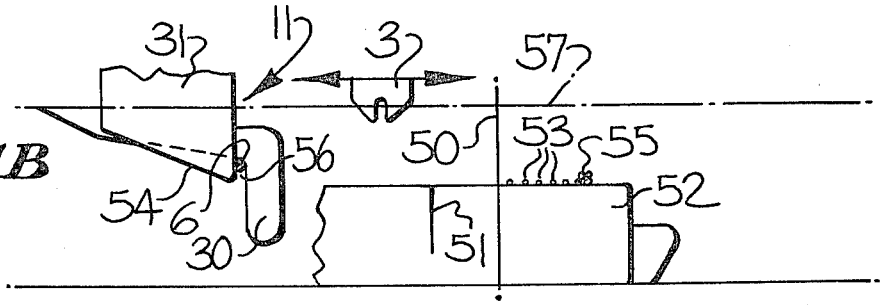

In the phase of FIG. 11B, the auxiliary yarn guide moves into the range of traverse stroke CH. In doing so, the yarn slides upward along inclined surface 54, and is thereby lifted out of traversing yarn guide 3 and caught in the yarn guide slot 56 between finger 30 and plate 31. For this purpose, in the embodiment according to FIG. 9, piston 33 is acted upon by pressure via line 37, while piston 44 receives pressure via line 46.

Figure 11C:
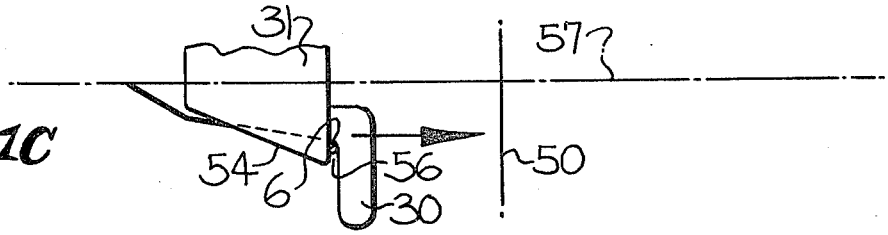
Figure 11D:
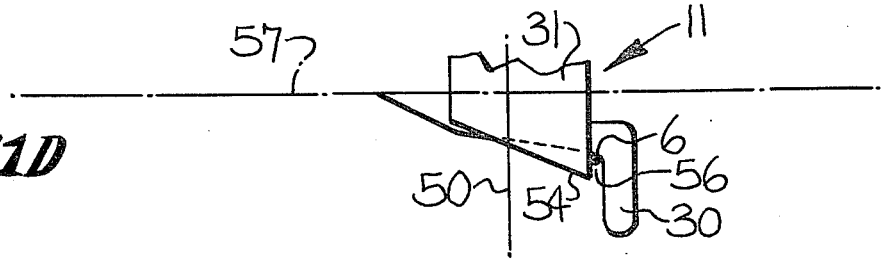

In the phase of FIG. 11C, the auxiliary yarn guide is moved at a low speed through the normal plane of yarn catching notch 51, until the yarn has been caught and wound on tube 52. Now, the auxiliary guide moves at fast speed to the right and into area 55, where, by a short temporary stop (FIG. 11D), a transfer tail securing bead is formed. In the phases of FIGS. 11C and 11D, piston 33 is acted upon by different and increasing pressure via line 36. The yarn then moves quickly across the area 53, where a transfer tail consisting of a few windings is formed. For this purpose, piston 33 receives pressure via line 37.

Figure 11E:
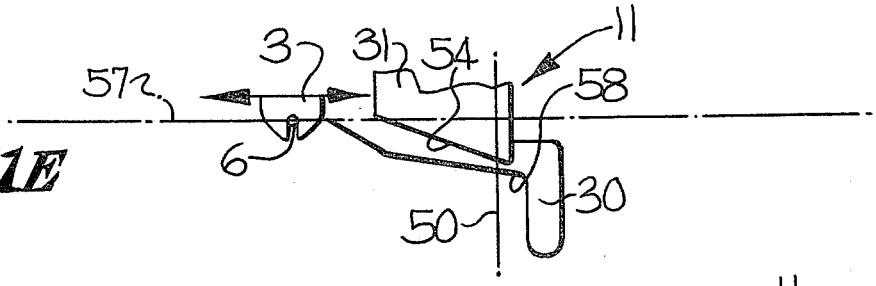
Figure 11F:
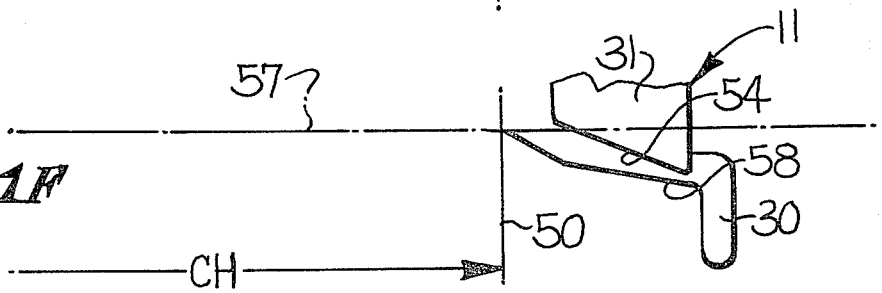

In the phase of FIG. 11E, the auxiliary yarn guide stops outside of the traverse range CH. Plate 31 is retracted behind the bottom 58 of yarn guide slot 56. Due to its inherent tension, the yarn moves into the traverse range CH, where it is recaptured by yarn guide 3 or the grooves of a grooved roller. To do so, piston 44 receives pressure via line 47. In the phase of FIG. 11F, the auxiliary yarn guide returns to its idle position by applying pressure to piston 33 via line 36. Then piston 44 is acted upon by pressure via line 46, which makes plate 31 return to its position shown in FIG. 11A.

As is shown in the flow charts according to FIGS. 10 and 11, the disclosed auxiliary yarn guide 11 can be advantageously used in a method according to this application, or in other methods, for doffing packages while winding a running yarn, so as to lift the yarn out of the traverse motion device, to catch it on the bobbin, in the winding range or outside of same, and to form a transfer tail consisting of a few windings.

Figure 12:
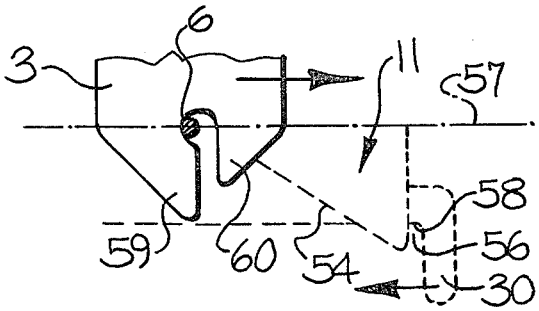
FIG. 12 is a fragmentary top plan view of a traversing yarn guide in accordance with the present invention.

FIG. 12 illustrates a preferred traversing yarn guide 3, in a position shortly before capture of the yarn in the phase of FIGS. 10B or 11B. The guide 3 comprises a plate-like member having a bifurcated forward end which is defined by a pair of flanks 59, 60. The flanks are laterally separated to form a slot therebetween and are of different lengths. More particularly, flank 59 extends further into threadline plane 57 than the other flank 60. This helps in insuring that the yarn does not jump out of the slot formed between the two flanks. Also, each of the flanks includes an outer edge, which are oppositely inclined toward a point adjacent the opening of the slot. Another special feature resides in the fact that the slot between flanks 59 and 60 has a recess 61 at its bottom, which formed in the edge of the flank 59. This placement of the recess operates to insure that when the yarn slides upwardly along the inclined surface 54 of auxiliary guide 11, it will be held in the bottom of the slot and released only when traversing yarn guide 3 reverses its direction of movement. This assures that the yarn reaches the slot 56 and drops to the bottom 58 thereof.

In the drawings and specification, there has been set forth a preferred embodiment of the invention, and although specific terms are employed, they are used in a generic and descriptive sense only and not for purposes of limitation.

That which is claimed is:

1. A method for continuously winding a high speed running yarn or the like onto bobbins serially delivered to a winding position, and without yarn stoppage or loss of yarn between bobbin changes, and comprising the steps of, winding the running yarn onto a rotating first bobbin positioned at the winding position, and including traversing the yarn at a location upstream of the winding position to thereby form a cross-wound package on the bobbin, laterally separating the rotating first bobbin with respect to the traversing location upon the bobbin becoming full, and such that the length of the running yarn between the traversing location and the full bobbin increases, and the traverse stroke of the yarn on the full bobbin decreases, and while continuing to wind the yarn onto the rotating full bobbin, moving an empty rotating second bobbin and an associated yarn catching notch to the running yarn path of travel between the traversing location and the laterally separated full bobbin, and such that the yarn catching notch is positioned axially beyond the yarn traverse stroke which is defined along such empty second bobbin, axially displacing the laterally separated rotating full bobbin so that an end portion thereof is laterally aligned with the plane of the yarn catching notch, and while continuing to wind the yarn thereon, terminating the traverse of the running yarn and moving the yarn into the plane of the yarn catching notch, and so that the yarn is wound on the end portion of the rotating full bobbin and until it is caught by the notch, and with the yarn then being wound on the rotating empty second bobbin.

2. The method as defined in claim 1 comprising the further subsequent step of moving the running yarn laterally toward the normal yarn traverse stroke along the rotating empty second bobbin to form a transfer tail.

3. The method as defined in claim 2 comprising the further subsequent step of again traversing the yarn to form a cross-wound package on the second bobbin.

4. The method as defined in any one of claims 1–3 wherein the rotating second bobbin is moved into the yarn path of travel so that the surface movement on the side of the rotating bobbin adjacent the yarn path of travel opposes the direction of the yarn movement.

5. The method as defined in any one of claims 1–3 wherein the traversing step includes advancing the running yarn over a grooved roller having reversing grooves at each end thereof, and such that during the winding step the yarn is looped by at least 60 degrees over the grooved roller, and during the laterally separating step the full bobbin moves with respect to the traversing location so as to cause the looping angle to be reduced to less than about 45 degrees and the yarn to drop from the reversing grooves to thereby further reduce the yarn traverse stroke on the full bobbin.

6. The method as defined in any one of claims 1–3 wherein the empty second bobbin is rotated during the moving step at a surface speed which generally corresponds to the yarn speed.

7. The method as defined in any one of claims 1–3 wherein the full bobbin is rotatably driven during the laterally separating step at a surface speed which generally corresponds to the yarn speed.

8. The method as defined in any one of claims 1–3 wherein the winding step includes contacting the wound surface of the bobbin with a drive roller, and wherein the drive roller and traversing location move laterally away from the full bobbin during the laterally separating step.

9. The method as defined in any one of claims 1–3 wherein the axial displacement of the full bobbin is accomplished with slight acceleration and deceleration, so as to avoid shock and vibration during such displacement.

10. The method as defined in any one of claims 1–3 wherein the axial displacement of the full bobbin is less than half of the reduction in the length of the yarn traverse stroke between that at the winding position and that at the laterally separated position of the full bobbin.

11. The method as defined in claim 10 wherein the axial displacement of the full bobbin is greater than the axial spacing between the yarn catching notch and the adjacent edge of the yarn traverse stroke on the second bobbin at the winding position.

12. The method as defined in claim 1 wherein the step of traversing the yarn at a location upstream of the winding position includes operatively engaging the yarn with yarn traversing means, and the step of terminating the traverse of the running yarn includes operatively engaging the running yarn with an auxiliary yarn guide and so as to separate the running yarn from the traversing means.

13. The method as defined in claim 12 wherein the step of moving the yarn into the plane of the yarn catching notch includes moving the auxiliary yarn guide and the engaged running yarn to such plane.

14. The method as defined in claim 13 comprising the further subsequent steps of releasing the running yarn from the auxiliary yarn guide, and then operatively engaging the released yarn with the traversing means to commence formation of a cross wound package on the empty second bobbin.

15. An apparatus for continuously winding a high speed running yarn or the like onto bobbins serially delivered to a winding position, and without yarn stoppage or loss of yarn between bobbin changes, and comprising means rotatably mounting at least two bobbin receiving chucks for selective movement wherein each chuck and associated bobbin may be serially delivered to and withdrawn from a winding position, drive means for rotating a bobbin received on a chuck at the winding position, yarn traversing means mounted at a location upstream of the winding position for traversing the running yarn to form a cross-wound package on the rotating bobbin at the winding position, control means for laterally separating a first chuck at the winding position with respect to the traversing means upon the bobbin received on said chuck becoming full, and such that the length of the running yarn between the traversing means and the full bobbin increases, and the traverse stroke of the yarn on the full bobbin decreases, and while permitting the full bobbin to continue to rotate and wind thereon, and for moving a second chuck mounting an empty bobbin and an associated yarn catching notch adjacent one end of the bobbin, to a yarn engaging position between the traversing means and the full bobbin when the full bobbin is in its position separated from the traversing means, and such that the yarn catching notch is positioned axially beyond the yarn traverse stroke which is defined along such empty bobbin, means for axially displacing the first chuck and rotating full bobbin when in the position separated from the traversing means so that an end portion of the full bobbin is laterally aligned with the plane of the yarn catching notch associated with the second chuck at said yarn engaging position, and means for terminating the traverse of the running yarn and moving the yarn into the plane of the yarn catching notch when the second chuck is in said yarn engaging position, and such that the yarn is wound on the end portion of the rotating full bobbin until it is caught by the notch.

16. The apparatus as defined in claim 15 wherein said control means further comprises means for rotating each chuck and its associated bobbin during movement to said yarn engaging position, and such that the yarn is wound on the rotating empty bobbin immediately upon the yarn being caught by the notch.

17. An apparatus for continuously winding a high speed running yarn or the like onto bobbins serially delivered to a winding position and without yarn stoppage or loss of yarn between bobbin changes, and comprising a bobbin revolver rotatably mounting at least two chucks, with each chuck adapted to mount at least one tubular bobbin, and such that each chuck and associated bobbin may be selectively moved between a winding position and a doffing position, and with each chuck and associated bobbin including a yarn catching notch adjacent one end of the bobbin, means for winding a running yarn onto a bobbin at the winding position, and including means for rotating such bobbin, and traversing means mounted at a location upstream of the winding position for traversing a running yarn to define a traverse stroke on such rotating bobbin and form a cross wound package thereupon, means for selectively rotating the bobbin revolver so as to move a first chuck and associated full bobbin at the winding position toward the doffing position while moving a second chuck and associated empty bobbin toward the winding position, and such that during movement of the first chuck toward the doffing position the length of the running yarn between the traversing means and the full bobbin increases and the lateral stroke of the yarn on the full bobbin decreases, and the empty bobbin moves into the plane defined by the traversing yarn stroke, with the yarn catching notch being positioned axially beyond the yarn traverse stroke which is defined along such empty bobbin, means for axially displacing the first chuck and associated full bobbin at the doffing position in the direction so that an end portion of the full bobbin is aligned with the plane of a yarn catching notch on the second chuck, and auxiliary yarn guide means for selectively removing the advancing yarn from the traversing means and moving the yarn into the plane of a yarn catching notch on the second chuck, whereby the yarn is wound on the end portion of the full bobbin until it is caught by the yarn catching notch on the second chuck.

18. The apparatus as defined in claim 17 wherein said winding means includes a support slide mounting said yarn traversing means, and with said support slide being mounted for movement along a direction generally parallel to the direction of yarn movement.

19. The apparatus as defined in claim 18 wherein said means for rotating a bobbin at the winding position includes a surface drive roller mounted on said support slide.

20. The apparatus as defined in any one of claims 17–19 wherein said yarn traversing means includes a plurality of separate traversing guides, whereby a plurality of yarns may be respectively wound on a like number of bobbins mounted coaxially on each of said chucks.

21. The apparatus as defined in any one of claims 17–19 wherein said bobbin revolver includes rotational drive means for rotating each of the chucks and the associated bobbins at a circumferential speed generally corresponding to the yarn speed.

22. The apparatus as defined in claim 21 wherein said drive means comprises a motor mounted on the bobbin revolver coaxially with each chuck.

23. An auxiliary yarn guide adapted to selectively engage a traversing yarn in a high speed yarn winding machine, and to move the running yarn beyond its normal traverse stroke, in order to facilitate the yarn transfer onto empty bobbins which are serially presented to a winding station, or the like, and comprising a support member, means mounting said support member to the frame of a winding machine or the like so as to permit selective movement in opposite directions along a linear path of travel which is parallel to the yarn traverse stroke of the winding machine, means for selectively moving said support member in each of said directions along said path of travel, a guide finger fixed to said support member and extending transversely therefrom in a direction so as to be adapted to intersect the plane of the traversing yarn stroke of the winding machine, a guide plate mounted to said supporting member for relative movement in a direction perpendicular to said path of travel, and between an extended position and a witdrawn position, with said guide plate being located immediately adjacent said guide finger so as to define a yarn receiving gap between said guide finger and one side of said guide plate when said plate is in said extended position, and with said guide plate including a forward edge which is inclined outwardly in a direction toward said finger, and means for selectively moving said guide finger between said extended and withdrawn positions, whereby movement of said support member is adapted to move the guide finger and extended guide plate into the operative range of the traversing yarn stroke so that the yarn moves along the outwardly inclined forward edge of said plate and is caught within the gap between the finger and plate, and movement in the opposite direction acts to move the yarn outside the normal traverse stroke, and wherein the yarn may be released by withdrawing the plate to its withdrawn position.

24. The auxiliary yarn guide as defined in claim 23 wherein said support member is tubular, and said means for selectively moving said guide finger comprises a rod slidably mounted within said tubular support member, means for effecting axial movement of said rod in each direction with respect to said support member, and pin and slot means interconnecting said rod and said guide plate for causing said guide plate to move perpendicularly to the rod upon axial movement of said rod relative to said support member.

* * * * *